US005347733A

United States Patent [19]

Whittington

[11] Patent Number: 5,347,733

[45] Date of Patent: Sep. 20, 1994

[54] MAGNETIC NAME TAG

[76] Inventor: Richard W. Whittington, 2355 Huntington Place, Cordova, Tenn. 38018

[21] Appl. No.: 859,906

[22] Filed: Mar. 30, 1992

[51] Int. Cl.[5] ..... A44C 3/00

[52] U.S. Cl. ..... 40/1.5; 24/303; 335/302; 40/600

[58] Field of Search ..... 40/600, 621; 24/303; 335/285, 296, 302

[56] References Cited

U.S. PATENT DOCUMENTS

| | | | |
|---|---|---|---|
| 2,353,550 | 7/1944 | De Forest et al. | 335/302 |
| 2,949,569 | 8/1960 | Pierce et al. | 335/302 |
| 2,975,497 | 3/1961 | Budreck | 40/621 |
| 2,975,539 | 3/1961 | Anderson | 40/621 |
| 3,064,330 | 11/1962 | Skidmore | 40/621 |
| 3,086,268 | 4/1963 | Chaffin, Jr. | 40/621 |
| 4,236,331 | 12/1980 | Mattson | 40/1.5 |
| 4,968,972 | 11/1990 | Conipe | 335/302 |

FOREIGN PATENT DOCUMENTS

| | | | |
|---|---|---|---|
| 849878 | 9/1952 | Fed. Rep. of Germany | 335/302 |
| 2614186 | 10/1988 | France | 40/600 |
| 112705 | 9/1981 | Japan | 335/302 |
| 392891 | 8/1931 | United Kingdom | 335/302 |
| 799548 | 8/1958 | United Kingdom | 335/302 |

*Primary Examiner*—Kenneth J. Dorner
*Assistant Examiner*—Cassandra Davis
*Attorney, Agent, or Firm*—Hill, Steadman & Simpson

[57] ABSTRACT

A magnetic name tag has a pole piece panel elongated in one direction and with opposite end portions. One or more magnets assembled with the pole piece panel establish respective separate, complete magnetic flux paths at each of the end portions. A magnetically attractive keep plate elongated in generally complementary relation to the pole piece panel carries indicia thereon. The keep plate is attracted towards the magnet by the magnetic flux paths which effect a stabilized magnetic holding attraction for the keep plate in any assembled orientation of the pole piece and magnet assembly relative to the keep plate.

9 Claims, 1 Drawing Sheet

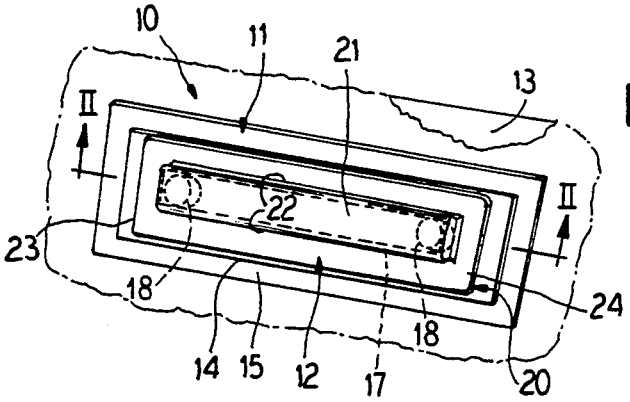
FIG. 1
FIG. 2
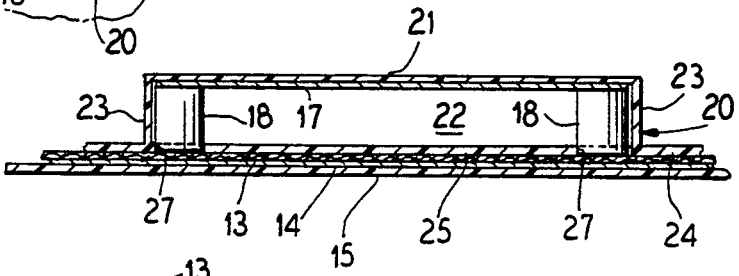
FIG. 3
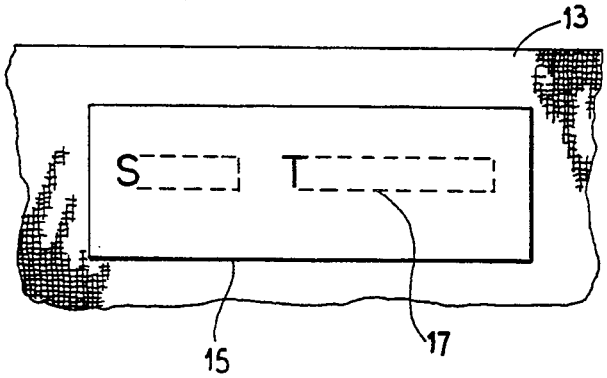
FIG. 5
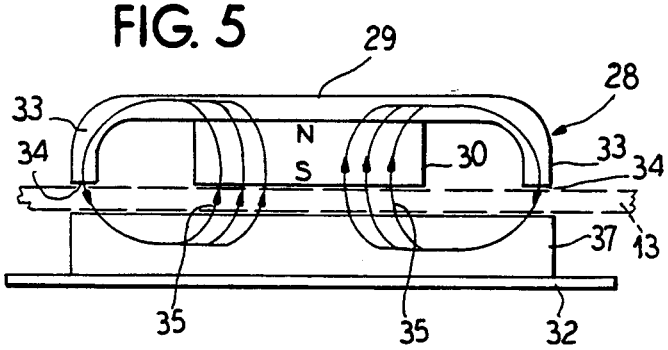
FIG. 4
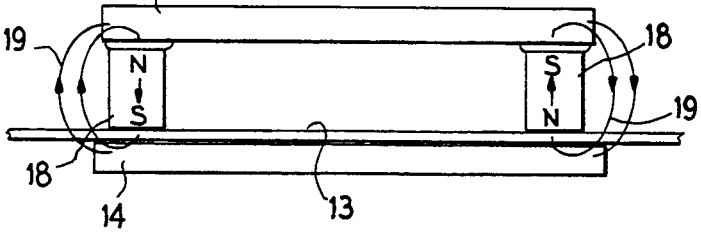

MAGNETIC NAME TAG

BACKGROUND OF THE INVENTION

The present invention relates to a new and improved wearable identifies or name tag construction wherein complementary tag panels are adapted to clamp a fabric supporting member separably between the panels.

Although various and sundry identifiers or name badges and tags have been proposed, among them the magnetic badge assembly disclosed in U.S. Pat. No. 4,236,331, there is nevertheless room for improvement. In particular improved retention of the assembly in the clamp-on manner of attachment to a fabric member, such as an article of clothing, is desirable.

As pointed out in the aforesaid U.S. patent, an important advantage of magnetic badges, or name tags, has been the elimination of any penetrating devices such as a pin for attaching the name tag in place in use, affording considerable convenience and versatility for this type of name tags.

SUMMARY OF THE PRESENT INVENTION

An important object of the present invention is to provide a new and improved wearable magnetic identifier or name tag construction having superior attachment and holding quality.

Another object of the present invention is to provide a new and improved wearable magnetic identifier or name tag which is possessed of especially stable clamp-on facility.

A further object of the present invention is to provide an improved wearable magnetic identifier or name tag which is simple, efficient and economical in construction, having regard to the improvements embodied therein.

Accordingly to the principles of the present invention there is provided a wearable magnetic identifier or magnetic name tag comprising, a pole piece panel having opposite end portions, magnetic means assembled with the pole piece panel for establishing a like magnetic flux path at each of the end portions of the pole piece panel, a magnetically attractive keep plate opposed to the pole piece panel and carrying indicia means for display, and the magnetic flux paths effecting a stabilized magnetic holding attraction for the keep plate assembled orientation of the pole piece and magnetic means assembly relative to the keep plate.

BRIEF DESCRIPTION OF THE DRAWINGS

Other objects, features and advantages of the invention will be readily apparent from the following description of certain representative embodiments thereof, taken in conjunction with the accompanying drawing although variations and modifications may be effected without departing from the spirit and scope of the novel concepts embodied in the disclosure, and in which:

FIG. 1 is a perspective view of a best mode embodiment of the present invention;

FIG. 2 is a longitudinal sectional detailed view taken substantially along the line II—II in FIG. 1;

FIG. 3 is a front elevational view of the wearable magnetic identifier or name tag of FIG. I;

FIG. 4 is a schematic illustrative view demonstrating operation of the magnetic name tag of FIG. I; and FIG. 5 is an illustrative schematic view showing a modification of the wearable magnetic identifier or name tag and its magnetic operation.

DETAILED DESCRIPTION

As shown in FIGS. 1–4, a wearable magnetic identifier or name tag 10 embodying the present invention comprises a magnetically attractive name plate structure 11 and a magnetic fastener 12 cooperative for clamping onto a member a through which magnetism can pass freely, such as a garment, i.e. a fabric area such as on a dress, and on a shirt or jacket pocket, exemplified at 13.

The name plate structure 11 comprises simply a magnetically attractive keep plate 14 of desired length and width, for example about 2¾ inch (7 centimeters) long and three-quarters inch (19 millimeters) wide, bonded to identifier means such as a name plate, or the like 15 which may be a little longer and wider than the keep plate. The name plate 15 desirably carries indicia means 16 for display, such as user name, advertising, identification means, and the like. In a desirable construction, the keep plate 14 may be magnetically attractive metal of as thin as practical material, and the name plate 15 may be formed from any desired composition such as rigid plastic bonded to the keep plate 14 by means such as adhesive.

The fastener 12 desirably compromises an elongate pole piece panel 17, which may be somewhat shorter and narrower than the keep plate 14 and formed from suitable ferromagnetic material. Magnetic means, comprising respective magnets 18 are assembled in spaced relation and with each of the opposite magnet end portions of the pole piece panel 17 for establishing a like magnetic flux path 19 at each end portion. Desirably, the magnets 18 are as small as practicable for attainment of the desired magnetic attraction, and as shown may be of cylindrical form having opposite flat ends. One of the magnets 18 should have its north pole, i.e., N pole attached by permanent bonding to the pole piece 17, and the opposite magnet 18 should have its South pole, i.e., S pole attached by permanent bonding to the pole piece 17. Attachment of the magnets 18 to the pole piece panel 17 may be effected by any known bonding technique for attainment of free flux movement between the pole piece panel 17 and the magnets 18 and to attain efficient magnetomotive force at the free end poles of the magnets. Excellent results have been attained by use of cylindrical button type neodymium magnets. This arrangement provides for superior, stabilized magnetic attraction of the keep panel 14 in spite of the reluctance at the air gaps between the magnets 18 and the keep plate 14 caused by the intervening fabric member 13 to which the magnetic name tag 10 is applied in use.

If there is concern about possible affect of any metal part of the magnetic name tag 10 on the wearer's skin, the fastener assembly 12 may be provided with a protective jacket 20 which may be formed from a synthetic rubber or plastic material so that the protective jacket may be easily formed as by molding and applied and sealed. A desirable finished form of the protective jacket 20 comprises a crown cover portion 21 over the pole piece panel 17. Each longitudinal side of the jacket 20 has an integral skirt portion 22 which is integral with the crown portion 21, and respective opposite end closure portions 23 are integrally joined to the crown portion 21 and the skirt portions 22. Integral with the skirt portions 22 and end closure portions 23 is a base flange lip 24 which, in turn, is attached to a base cover area portion 25.

To avoid excessive reluctance which might be caused by intervention of parts of the jacket base area 25 between the magnetomotive force free ends of the magnets 18 and the keep plate 14 in assembly of the name tag components 11 and 12 in service, respective flux ports 27 are provided in the base area portion 25 in line with and desirably about the same diameter as the adjacent ends of the respective magnets 18. By preference the ends of the magnets 18 at the ports 27 may be inset relative to the outer plane of the base cover 25 on the order of 1/50th an inch (½ millimeter). This provides a slight clearance, with minimum air gap reluctance, between the keep plate 14 and the adjacent ends of the magnets 18, but contributes to ease of relative sliding movement of the component assemblies 11 and 12 of the magnetic name tag 10, without interfering with firm magnetic holding coaction between the assemblies. On the other hand, if preferred, the free ends of the magnets may be even with or project slightly relative to the outer face of the base cover 25.

If for any reason there might be concern with possible contact of the keep plate 14 with a users skin, at least exposed edges of the keep plate may be coated with a thin rubber or plastic protective coating. However, where the indicia carrying panel 15 provides a spacing flange barrier extension about the keep plate 14, there may be sufficient protective non-metallic buffer to avoid need for a protective buffer coating on the keep plate.

It may also be noted that the protectively jacketed magnetic holder or fastener 12 by reason of its rib-like structure provides a protective spacer between a person and any exposed area of the keep plate 14.

In another best mode example of wearable magnetic identifier or name tag 28 (FIG. 5) there is provided a pole piece panel 29 carrying magnetic means in the form of a single-pole, rectangular block magnet 30, and a keep plate 31 carrying indicia panel 32. The magnet 30 is preferably of the neodymium type in a generally flat rectangular bar form having its N pole at the surface which is fixedly attached in efficient magnetic flux relation to the pole piece panel 29. Desirable flux path results are attained by having the pole piece panel 29 of elongated form with respective opposite end similarly turned portions 33 of preferably equal length and with their free terminal ends 34 in a common plane with one another and in substantially common plane with the S pole face of the magnet For maximum efficiency, the air gap between the turned end portions 33 of the pole piece 29 and the adjacent ends of the magnet 30 should be at least ten times greater than the average gap anticipated between the pole piece terminal ends 34 and the magnetically attractive keep plate 31 in service, that is the air gap which is provided by an intervening fabric member to which the magnetic name tag 28 may be self-retainingly separably attached. The arrangement of the name tag 28 is such that there is a highly efficient magnetic flux path 35 through the magnet 30 and each of the pole piece turned end portions 33 and the keep plate 31 in their assembled relation, substantially as shown schematically in FIG. 5.

If desired, the pole piece 29 and possibly also the keep plate 31 may be protectively coated or jacketed, similarly as described in connection with the wearable magnetic identifier or name tag construction 10 of FIG. 1. In such event, not only the pole piece panel terminal ends 34 but also the keep-contiguous surface of the magnet 30 should be left exposed toward the keep plate similarly as the ends of the magnets 18 are exposed at the flux ports 27 as shown in FIG. 2.

In respect to both forms of the invention disclosed in the wearable magnetic identifier or name tags 10 and 28, highly efficient self-retaining separable attachment of the name tag assembly is attained. Safe attachment of the name tag is assured to even the finest garment fabric.

It will be understood that variations and modifications may be affected without departing from the spirit and scope of the novel concepts of this invention.

I claim as my invention:

1. A wearable magnetic identifier or name tag, comprising:

a pole piece panel elongated in one direction and having opposite end portions;

magnetic means assembled with said pole piece panel for establishing a first, complete magnetic flux path at a first of said end portions and a second complete magnetic flux path at a second of said end portions, separate from said first magnetic flux path;

a magnetically attractive keep plate elongated in generally complementary relation to said pole piece panel and carrying indicia means for display;

said keep plate attracted towards said magnetic flux paths which effect a stabilized magnetic holding attraction for said keep plate in any assembled orientation of the pole piece and magnetic means assembly relative to said keep plate;

said magnetic means and pole piece panel assembly and said keep plate having protective buffer means thereon.

2. A name tag, identifier, accordingly to claim 1, wherein said magnetic means comprise respective first and second magnets attached to said opposite end portions of said pole piece panel.

3. A name tag, identifier, according to claim 2, wherein said magnets comprise generally button type magnets wherein the N pole of the first of the magnets is attached to the pole piece panel and the S pole of the second magnet is attached to the pole piece panel.

4. A magnetic name tag, identifier, according to claim 1, wherein said magnetic means comprising at least one neodymium magnet.

5. A wearable magnetic identifier or name tag, comprising:

a pole piece panel elongated in one direction and having opposite end portions;

magnetic means assembled with said pole piece panel for establishing a first, complete magnetic flux path at a first of said end portions and a second complete magnetic flux path at a second of said end portions, separate from said first magnetic flux path;

a magnetically attractive keep plate elongated in generally complementary relation to said pole piece panel and carrying indicia means for display;

said keep plate attracted towards said magnetic flux paths which effect a stabilized magnetic holding attraction for said keep plate in any assembled orientation of the pole piece and magnetic means assembly relative to said keep plate;

said magnetic means comprising respective first and second magnets attached to said opposite end portions of said pole piece panel;

said magnets comprising generally button type magnets wherein the N pole of the first of the magnets is attached to the pole piece panel and the S pole of the second magnet is attached to the pole piece panel; and said pole piece panel and magnet comprising a holder component for the name tag, identifier;

and a protective jacket enclosing said holder component.

6. A name tag, identifier according to claim 5, wherein said protective jacket comprises a thin non-metallic material, including a base closure having magnetic flux ports aligned with said magnets.

7. A wearable magnetic identifier or name tag, comprising:

a pole piece panel having opposite end portions;

a first generally button type magnet secured in positive magnetic being path relation to one end portion of the pole piece panel and a second generally button type magnet secured to the opposite end portion of the pole piece panel;

each button magnet having a complete magnetic flux path associated therewith, the respective magnetic flux paths effected by said button magnets being separate and establishing magnetic holding attraction for a keep plate assembled releasably therewith; and a protective jacket comprising thin non-metallic material enclosing said pole piece panel and magnets.

8. A name tag, identifier, according to claim 7, wherein said jacket includes a base closure portion having clearance ports aligned with free ends of said magnets.

9. A name tag, identifier, according to claim 7, wherein said magnets are neodymium magnets.

* * * * *